US008419162B2

(12) United States Patent
Sakano

(10) Patent No.: US 8,419,162 B2
(45) Date of Patent: Apr. 16, 2013

(54) INKJET RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 75 days.

(21) Appl. No.: 13/076,130

(22) Filed: Mar. 30, 2011

(65) Prior Publication Data

US 2011/0267400 A1 Nov. 3, 2011

(30) Foreign Application Priority Data

Apr. 28, 2010 (JP) ..... 2010-103417

(51) Int. Cl.
*B41J 2/165* (2006.01)

(52) U.S. Cl.
USPC ..... 347/29; 347/32; 347/33

(58) Field of Classification Search ..... 347/29, 347/32
See application file for complete search history.

(56) References Cited

U.S. PATENT DOCUMENTS

| | | | | |
|---|---|---|---|---|
| 5,039,999 | A * | 8/1991 | Winslow et al. | 347/87 |
| 5,883,648 | A | 3/1999 | Hetzer | |
| 6,598,963 | B1 * | 7/2003 | Yamamoto et al. | 347/85 |
| 6,722,762 | B2 * | 4/2004 | Miyazawa et al. | 347/86 |
| 7,290,861 | B2 * | 11/2007 | Inoue et al. | 347/49 |
| 7,497,545 | B2 * | 3/2009 | Shimizu | 347/22 |
| 7,669,961 | B2 * | 3/2010 | Silverbrook et al. | 347/29 |
| 2001/0015742 | A1 * | 8/2001 | Childers | 347/85 |
| 2001/0038401 | A1 * | 11/2001 | Kawase et al. | 347/42 |
| 2002/0041303 | A1 * | 4/2002 | Yoshinaga | 347/22 |
| 2003/0007049 | A1 * | 1/2003 | Hino | 347/92 |
| 2003/0067505 | A1 * | 4/2003 | Kumagai | 347/35 |
| 2003/0122907 | A1 * | 7/2003 | Kim | 347/86 |
| 2003/0128257 | A1 * | 7/2003 | Qingguo et al. | 347/85 |
| 2005/0174408 | A1 * | 8/2005 | Qingguo et al. | 347/97 |
| 2005/0195254 | A1 * | 9/2005 | Takagi et al. | 347/85 |

(Continued)

FOREIGN PATENT DOCUMENTS

| | | |
|---|---|---|
| JP | H04-016357 A | 1/1992 |
| JP | H09-109403 A | 4/1997 |

(Continued)

OTHER PUBLICATIONS

European Patent Office, extended European Search Report for European Patent Application No. 11160418.7, dated Sep. 1, 2011.

*Primary Examiner* — Matthew Luu
*Assistant Examiner* — Lily Kemathe
(74) *Attorney, Agent, or Firm* — Baker Botts L.L.P.

(57) ABSTRACT

An inkjet recording apparatus includes: (a) a recording head; (b) a cap movable along a movement path between an extracted position and a retracted position, such that the cap covers a nozzle-opening surface of the recording head, when being positioned in the extracted position, and such that cap is located in an adjacent space adjacent to the recording head without covering the nozzle-opening surface, when being positioned in the retracted position; (c) a guide movable between a closing position and an opening position. The guide guides the recording sheet to be conveyed through a sheet conveyance space, and closes the movement path of the cap, when being positioned in the closing position. The guide opens the movement path of the cap, when being positioned in the opening position. The guide is positioned in the opening position when the cap is moved between the extracted and retracted positions, and is positioned in the closing position when the cap is positioned in the retracted position.

18 Claims, 6 Drawing Sheets

U.S. PATENT DOCUMENTS

| | | | | |
|---|---|---|---|---|
| 2006/0001696 | A1* | 1/2006 | Ha et al. | 347/32 |
| 2006/0007277 | A1* | 1/2006 | Lai | 347/85 |
| 2006/0028519 | A1* | 2/2006 | Nakamura et al. | 347/87 |
| 2006/0098070 | A1 | 5/2006 | Kumagai | |
| 2007/0040864 | A1* | 2/2007 | Jung et al. | 347/22 |
| 2007/0109348 | A1* | 5/2007 | Izawa et al. | 347/34 |
| 2007/0200904 | A1* | 8/2007 | Wilson et al. | 347/85 |
| 2007/0242112 | A1* | 10/2007 | Yazawa | 347/85 |
| 2008/0049063 | A1* | 2/2008 | Nakamura et al. | 347/20 |
| 2008/0055374 | A1* | 3/2008 | Yahiro | 347/85 |
| 2008/0143781 | A1* | 6/2008 | Inoue et al. | 347/34 |
| 2008/0231656 | A1 | 9/2008 | Kim | |
| 2008/0231671 | A1* | 9/2008 | Lee et al. | 347/85 |
| 2008/0316254 | A1* | 12/2008 | Byun | 347/36 |
| 2009/0066749 | A1* | 3/2009 | Young et al. | 347/36 |
| 2009/0073221 | A1* | 3/2009 | Yoda | 347/33 |
| 2009/0109254 | A1* | 4/2009 | Satake et al. | 347/16 |
| 2009/0147047 | A1* | 6/2009 | Hayashi | 347/36 |
| 2009/0195593 | A1* | 8/2009 | Iwanaga | 347/32 |

FOREIGN PATENT DOCUMENTS

| | | | |
|---|---|---|---|
| JP | 2005-111951 | A | 4/2005 |
| JP | 2006-159644 | A | 6/2006 |
| WO | 2005/044564 | A2 | 5/2005 |

* cited by examiner

INKJET RECORDING APPARATUS

CROSS REFERENCE TO RELATED APPLICATION

This application claims priority from Japanese Patent Application No. 2010-103417 filed on Apr. 28, 2010, the disclosure of which is herein incorporated by reference in its entirety.

BACKGROUND OF THE INVENTION

Field of the Invention

The present invention relates to an inkjet recording apparatus including a recording head having nozzles through which ink is to be ejected toward a sheet conveyance space.

In recent years, there is known an inkjet printer having a plurality of recording heads which are assigned for respective color inks (e.g., black, cyan, magenta and yellow inks) and which are arranged in a sheet conveyance direction wherein each of the recording heads has nozzles through which a corresponding one of color inks are to be ejected toward a sheet that is being conveyed in the sheet conveyance direction. In this inkjet printer, a plurality of caps are provided for covering nozzle-opening surfaces of the respective recording heads in which the nozzles are open. While a recording operation is not being carried out, the caps are positioned in respective covering positions for covering the nozzle-opening surface of the respective recording heads, for thereby protecting the nozzles from being dried and avoiding foreign substances from adhering to the nozzles.

SUMMARY OF THE INVENTION

While the above-described caps are not covering the nozzle-opening surface, they are being retracted to be positioned in respective non-covering positions that are located in respective spaces adjacent to the respective recording heads. In this arrangement, however, if a curled sheet is being conveyed while the recording heads are performing the recording operation, the curled sheet could be caused to enter between a gap between one of the recording heads and the corresponding cap thereby causing a possibility of problematic jamming of the sheet.

The present invention was made in view of such a background. It is therefore an object of the invention to provide an inkjet recording apparatus in which nozzles are protected without suffering from problematic sheet jamming.

The above object of the invention may be achieved according to a principle of the invention, which provides an inkjet recording apparatus including: (a) at least one recording head each having a nozzle-opening surface and configured to eject ink through nozzles opening in the nozzle-opening surface, toward a sheet conveyance, space through which a recording sheet is to be conveyed in a sheet conveyance direction; (b) at least one cap each movable along a movement path between an extracted position and a retracted position, such that each of the at least one cap covers the nozzle-opening surface of a corresponding one of the at least one recording head, when being positioned in the extracted position, and such that each of the at least one cap is located in an adjacent space adjacent to a corresponding one of the at least one recording head in the sheet conveyance direction without covering the nozzle-opening surface of the corresponding one of the at least one recording head, when being positioned in the retracted position; (c) at least one guide each movable between a closing position and an opening position, such that each of the at least one guide is closer to the sheet conveyance space than a corresponding one of the at least one cap positioned in the retracted position so as to guide the recording sheet to be conveyed through the sheet conveyance space and so as to close at least a part of the movement path of the corresponding one of the at least one cap, when being positioned in the closing position, and such that each of the at least one guide opens the movement path of a corresponding one of the at least one cap, when being positioned in the opening position; and (d) each of the at least one guide being positioned in the opening position when a corresponding one of the at least one cap is moved between the extracted position and the retracted position, and being positioned in the closing position when the corresponding one of the at least one cap is positioned in the retracted position.

In the inkjet recording apparatus according to the principle of the invention, each of the at least one guide is positioned in the opening position thereby allowing a corresponding one of the at least one cap to be moved from the retracted position to the extracted position, so that the corresponding one of the at least one cap positioned in the extracted position serve to protect the nozzles of a corresponding one of the at least one recording head from being dried and to avoid foreign substances from adhering to the nozzles. Further, when each of the at least one cap is being positioned in the retracted position, a corresponding one of the at least one guide is positioned in the closing position, whereby a recording sheet is prevented from entering the adjacent space (in which the cap is being retracted) and accordingly problematic sheet jamming is avoided during a recording operation performed by the recording heads.

Therefore, in the inkjet recording apparatus according to the invention, both of the protection of the nozzles and the prevention of sheet jamming can be made satisfactorily.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

There will be described embodiments of the present invention, with reference to the accompanying drawings.

[First Embodiment]

Figure 1:
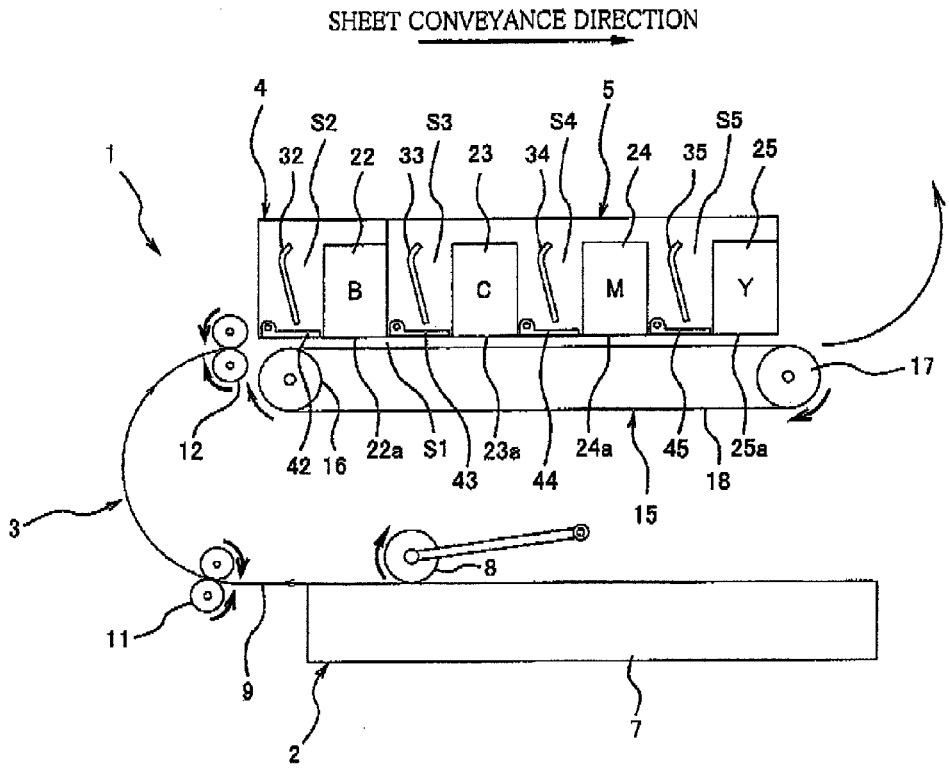
FIG. 1 is a side view showing an inkjet recording apparatus constructed according to a first embodiment of the invention.

FIG. 1 shows an inkjet recording apparatus 1 constructed according to a first embodiment of the invention. As shown in FIG. 1, the recording apparatus 1 includes a supplying device 2 configured to supply a sheet, a conveying device 3 configured to convey the sheet supplied from the supplying device 2, an upstream unit 4 configured to eject black ink droplets toward the sheet conveyed by the conveying device 3, and a downstream unit 5 configured to eject color ink droplets toward the sheet conveyed onto a downstream side of the upstream unit 4 by the conveying device 3. It is noted that the upstream unit 4 and the downstream unit 5 are vertically movable independently of each other.

The supplying device 2 includes a sheet supply tray 7 which is disposed in a bottom end portion of the inkjet recording apparatus 1, and a supplying roller 8 for supplying an uppermost one of the sheets stacked on the sheet supply tray 7, to a conveyance path 9. The conveyance path 9 includes an U-turn portion, a straight portion and another U-turn portion. The U-turn portion extends upwardly from a rear end portion of the sheet supply tray 7 and makes a turn toward a front end portion of the recording apparatus 1. The straight portion extends from the U-turn portion and passes below the upstream unit 4 and the downstream unit 5. The other U-turn portion extends upwardly from the straight portion and makes a turn toward a rear end portion of the recording apparatus 1 so as to reach a sheet exit space (not shown) that is located in an upper end portion of the recording apparatus 1.

The conveying device 3 includes conveying rollers 11, 12 provided for conveying the sheet (having been supplied from the supplying device 2) to below the upstream unit 4, and a belt conveyor 15 provided for conveying the sheet (having been conveyed by the conveying rollers 11, 12 and is held by the belt conveyor 15). The belt conveyor 15 includes a pair of belt pulleys 16, 17 and an endless belt 18 that is stretched around the two belt pulleys 16, 17. The endless belt 18 has an outer circumferential surface, onto which the sheet is to stick or adhere so as to be held by the belt 18. The belt conveyor 15 cooperates with the upstream unit 4 and downstream unit 5 to define a sheet conveyance space S1 that is located on an upper side of the belt conveyor 15 and on a lower side of the upstream and downstream units 4, 5. The sheet conveyance space S1 is a space in which a recording operation is to be performed onto the conveyed sheet.

The upstream unit 4 includes a black recording head (first recording head) 22 that is configured to eject black ink toward the sheet conveyance space S1. The downstream unit 5 includes a cyan recording head (second recording head) 23 that is configured to eject cyan ink toward the sheet conveyance space S1, a magenta recording head 24 that is configured to eject magenta ink toward the sheet conveyance space S1, and a yellow recording head 25 that is configured to yellow cyan ink toward the sheet conveyance space S1.

Each of the four recording heads 22-25 is a so-called line head which is constituted by a rectangular parallelepiped body that is elongated in a direction perpendicular to a sheet conveyance direction in which the sheet is to be conveyed through the sheet conveyance space S1. That is, the inkjet recording apparatus 1 is a so-called line printer that is capable of performing a printing operation at a velocity higher than a serial printer. The four recording heads 22-25 have respective nozzle-opening surface 22*a*-25*a* in which a multiplicity of nozzles open such that ink droplets can be ejected downwardly through the nozzles. To the four recording heads 22-25, the respective inks are supplied from respective ink tanks (not shown), and an ejection pressure is applied to each of the nozzles by a known actuator (not shown) such as a piezoelectric element. The four recording heads 22-25 are fixedly arranged in the sheet conveyance direction, and are spaced apart from each other in the sheet conveyance direction. There are four adjacent spaces S2-S5 each of which is adjacent to a corresponding one of the four recording heads 22-25 and each of which is located on an upstream side of the corresponding one of the four recording heads 22-25 in the sheet conveyance direction. Among the four adjacent spaces S2-S5, the adjacent space S3 is located between the black recording head 22 and the cyan recording head 23, the adjacent space S4 is located between the cyan recording head 23 and the magenta recording head 24, and adjacent space S5 is located between the magenta recording head 24 and the yellow recording head 25.

The upstream unit 4 is provided with a black-recording-head cap (first cap) 32 for covering the nozzle-opening surface 22*a* of the black recording head 22. The downstream unit 5 is provided with a cyan-recording-head cap (second cap) 33 for covering the nozzle-opening surface 28*a* of the cyan recording head 23, a magenta-recording-head cap 34 for covering the nozzle-opening surface 24*a* of the magenta recording head 24, and a yellow-recording-head cap 35 for covering the nozzle-opening surface 25*a* of the yellow recording head 25. It is noted that the black-recording-head cap 32 is hereinafter referred to as "upstream-unit cap" where appropriate, and that each of the cyan-recording-head cap 33, magenta-recording-head cap 34 and yellow-recording-head cap 35 is hereinafter referred to as "downstream-unit cap" where appropriate.

Each of the caps 32-35 is constituted by a generally plate-like shaped member that is elongated in the direction perpendicular to the sheet conveyance direction, and is constructed to be capable of covering a corresponding one of the nozzle-opening surfaces 22*a*-25*a*. Each of the caps 32-35 is movable along a movement path between an extracted position (i.e., covering position) and a retracted position (i.e., non-covering position), such that each of the caps 32-35 covers a corresponding one of the nozzle-opening surface 22*a*-25*a* of the respective recording heads 22-25, when being positioned in the extracted position, and such that each of the caps 32-35 is located in a corresponding one of the adjacent spaces S2-S5 which are adjacent to the respective recording heads 22-25 in the sheet conveyance direction without covering any of the nozzle-opening surfaces 22*a*-25*a* of the respective recording beads 22-25, when being positioned in the retracted position. FIG. 1 shows a state in which the caps 32-35 are positioned in the retracted positions. It is noted that the downstream unit caps 33-35 are movable in linkage with one another and that the downstream unit caps 33-35 are movable independently of the upstream unit cap 32.

The upstream unit 4 and downstream unit 5 are provided with guides 42-45 each of which is located to be closer to the sheet conveyance space S1 than a corresponding one of the caps 32-35 positioned in the retracted position, namely, each of which is located between the sheet conveyance space S1 and a corresponding one of the caps 32-35 positioned in the retracted position. Each of the guides 42-45 is constituted by a generally plate-like shaped member that is elongated in the direction perpendicular to the sheet conveyance direction, and is caused to close the adjacent spaces S2-S5 (which are adjacent to the respective recording heads 22-25) as seen from the sheet conveyance space S1. Each of the guides 42-45 is made substantially flush with a corresponding one of the nozzle-opening surfaces 22*a*-25*a* of the recording heads 22-25, when a corresponding one of the caps 32-35 is positioned in the retracted position. It is noted that the guides 42, 43 correspond to first and second guides.

Figure 2:
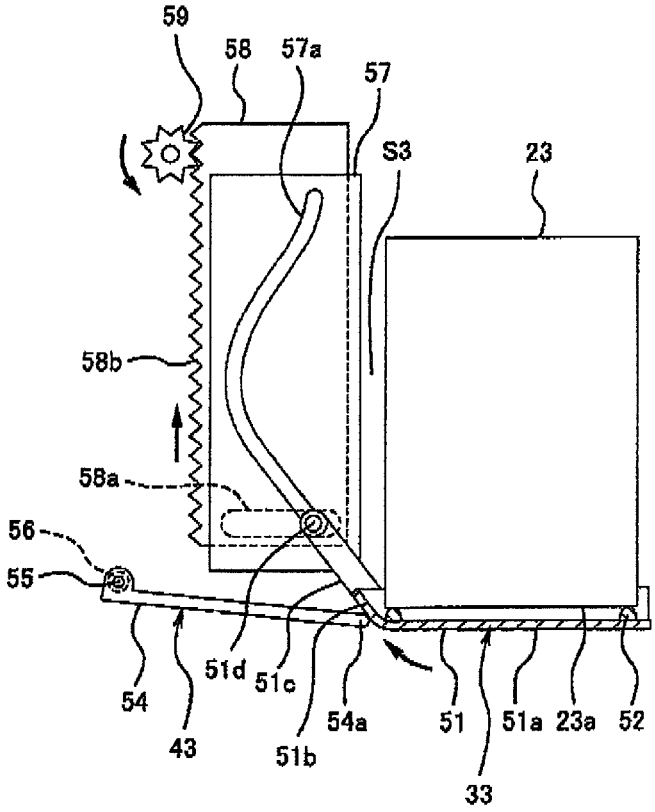
FIG. 2 is a view showing, in enlargement, a major portion of the inkjet recording apparatus of FIG. 1.

FIG. 2 shows in enlargement a major portion of the inkjet recording apparatus 1 of FIG. 1. Since the caps 32-35 are substantially the same to one another in construction and the guides 42-45 are also substantially the same to one another in construction, the following description is made for the cap 33 (i.e., one of the caps 32-35 which corresponds to the recording head 23) and the guide 43 (i.e., one of the guides 42-45 which corresponds to the recording head 23). As shown in FIG. 2, the cap 33 includes a cap body 51 and a seal member 52 that protrudes from the cap body 51. The cap body 51 is made principally of a resin, and serves to cover the nozzle-opening surface 28*a*. The seal member 52 is made of an elastic member, and serves to surround all the nozzles opening in the nozzle-opening surface 28*a* when being in contact with the nozzle-opening surface 23*a*. FIG. 2 shows a state in which the cap 33 is positioned in the extracted position. The cap body 51 includes a base portion 51*a*, an inclined wall portion 51*b*, an arm portion 51*c* and a shaft portion 51*d*. The base portion 51*a* is opposed to the nozzle-opening surface 23*a*. The inclined wall portion 51*b* extends from an upstream end of the base portion 51*a* (i.e., one of opposite ends of the base portion 51*a* which is adjacent to the guide 43) in an inclined direction such that a distance between the inclined wall portion 51*b* and the sheet conveyance space S1 is increased as the inclined wall portion 51*b* extends from the upstream end of the base portion 51*a* in the inclined direction. The arm portion 51*c* protrudes from the base portion 51*a* toward the adjacent space S3. The shaft portion 51*d* protrudes from the arm portion 51*c* in a longitudinal direction of the recording head 23 (i.e., in a direction away from a front side of the drawing sheet of FIG. 2 toward a rear side of the drawing sheet of FIG. 2).

In the adjacent space S3 adjacent to the recording head 23, there is disposed a plate-like shaped movement-path defining member 57 such that a normal line perpendicular to the plate-like shaped movement-path defining member 57 is parallel to the longitudinal direction of the recording head 23. A guide slot 57*a* is formed in the movement-path defining member 57, so as to guide the shaft portion 51*d* of the cap 33 which is introduced in the guide slot 57*a*. That is, with the shaft portion 51*d* being moved along the guide slot 57*a*, the cap 33 can be moved along a given movement path. It is noted that the cap 33 includes another shaft portion (not shown) which is to be guided by another guide slot (not shown), for causing the cap 33 to take a posture that avoids interference of the cap 33 with the recording head 23 during movement of the cap 33.

Further, a rack 58 is disposed in adjacent with the movement-path defining member 57, so as to be vertically movable relative to the rack 58. An elongated hole 58 is formed in the rack 58, and is elongated in the sheet conveyance direction. The elongated hole 58 receives the shaft portion 51*d* of the cap 33 which is introduced therein. The elongated hole 58 has a length (as measured in the sheet conveyance direction) which is slightly larger than a projected length of the guide slot 57*a* of the movement-path defining member 57 which is projected downwardly and is measured in the sheet conveyance direction. A pinion 59 is provided to mesh with a toothed portion 58*b* which is provided in a side surface of the rack 58 and which extends vertically. The pinion 59 can be rotated in forward and reverse directions by a downstream-unit cap motor 66 (see FIG. 3). When the pinion 59 is rotated in counterclockwise direction as seen in FIG. 2, the rack 58 is moved upwardly whereby the shaft portion 51*d* introduced in the elongated hole 58*a* is moved upwardly along the guide slot 57*a*. The upward movement of the shaft portion 51*d* along the guide slot 57*a* causes the cap 33 to be moved along the given movement path from the extracted position to the retracted position. When the pinion 59 is rotated in clockwise direction, the cap 33 is moved along the given movement path from the retracted position to the extracted position.

The guide 43 includes a plate-like shaped guide body 54, a supported shaft 55 and a spring 56 (e.g., torsion spring). The guide body 54 is made principally of a resin. The supported shaft 55 projects from an upstream end portion, as viewed in the sheet conveyance direction, of the guide body 54 in the longitudinal direction of the recording head 23. The spring 56 is provided to bias or constantly force the guide body 54 to be moved toward a closing position in which the guide body 54 is made flush with the nozzle opening surfaces 22*a*, 23*a* of the respective recording heads 22, 23 which are adjacent to the guide body 54. When the cap 33 is positioned in the extracted position, the cap body 51 is in contact at the inclined wall portion 51*b* with a downstream end portion 54*a* of the guide body 54 whereby the downstream end portion 54*a* (that is in proximity with the cap 33) of the guide 43 overlaps with a lower surface of the cap 33. The inclined wall portion 51*b* is inclined upwardly as the inclined wall portion 51*b* extends in a direction opposite to the sheet conveyance direction, so that the cap 33 can force the guide 43 to open and accordingly can be smoothly moved away from the extracted position toward the retracted position. When the cap 33 is positioned in the extracted position, a lower surface of the guide 48 is inclined downwardly as viewed in the sheet conveyance direction. That is, when the cap 33 is positioned in the extracted position, the downstream end portion Ma of the guide 48 is located in a position lower (closer to the sheet conveyance space S1) than a position in which the downstream end portion 54*a* of the guide 43 is located when the cap 33 is positioned in the retracted position.

Figure 3:
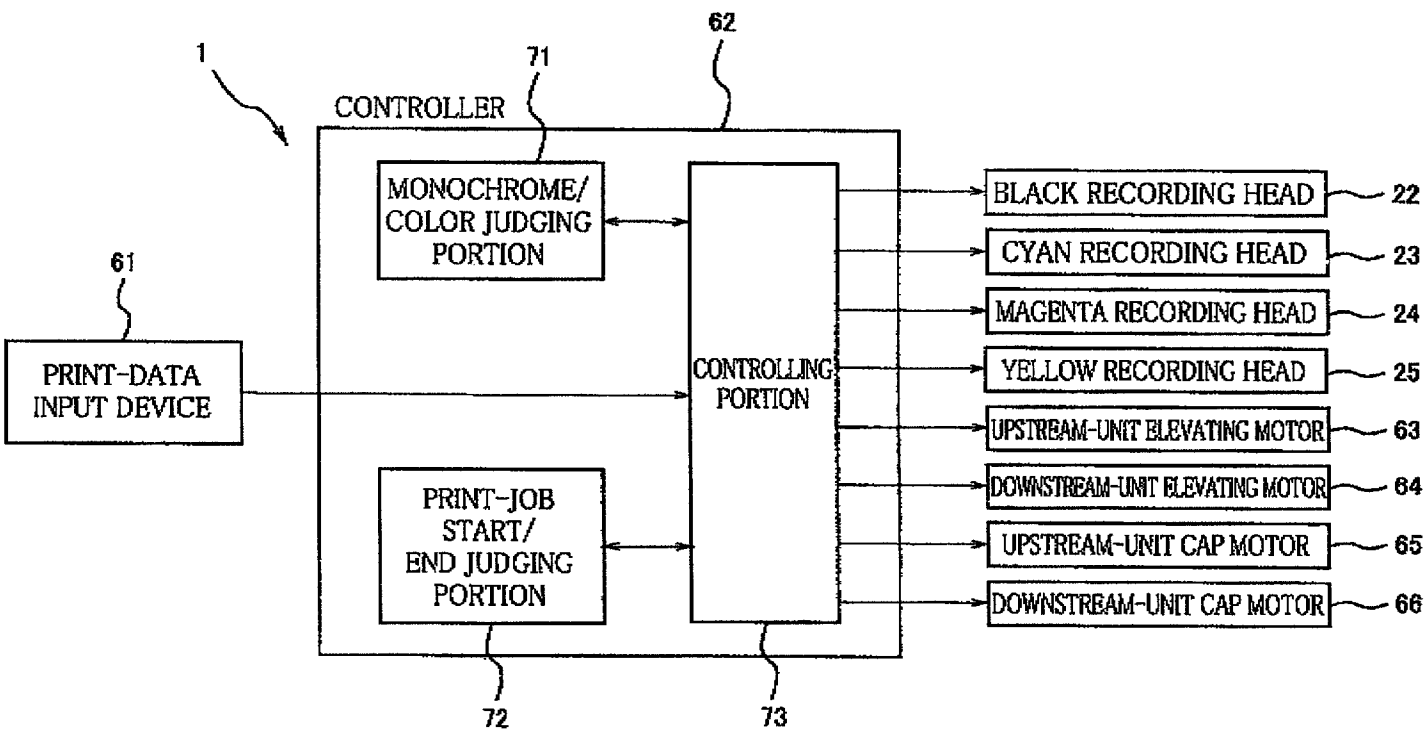
FIG. 3 is a block diagram of the inkjet recording apparatus of FIG. 1.

As shown in FIG. 3 that is a block diagram of the inkjet recording apparatus 1, the inkjet recording apparatus 1 includes, in addition to the above-described recording heads 22-25, a print-data input device 61, a controller 62, an upstream-unit elevating motor 63, a downstream-unit elevating motor 64, an upstream-unit cap motor 65 as a first-cap driving source, and a downstream-unit cap motor 66 as a second-cap driving source. The print-data input device 61 is connected to the controller 62 such that print data such as image data and monochrome/color data can be inputted to the controller 62 via the print-data input device 61. The controller 62 is configured to control the recording heads 22-25 and motors 63-66, based on the print data inputted via the print-data input device 61. The upstream-unit elevating motor 63 and downstream-unit elevating motor 64 are configured to move vertically the upstream unit 4 and downstream unit 5, respectively. The upstream-unit cap motor 65 and downstream-unit cap motor 66 are configured to move the caps 32-35 between the extracted positions and the retracted positions.

The controller 62 has a monochrome/color judging portion 71, a print-job start/end judging portion 72 and a controlling portion 78. The monochrome/color judging portion 71 is configured to judge, based on the print data inputted via the print-data input device 61, whether an image to be printed by a print job is a monochrome image or a color image. The print-job start/end judging portion 72 is configured to judge whether the print job is started and to judge whether the print job is ended. These judgments are made based on the print data which is inputted via the print-data input device 61 and print-state data which represents a current print state and which is supplied from the controlling portion 73. The controlling portion 73 is configured to control the motors 63-66, based on data supplied from the judging portions 71, 72.

Figure 4:
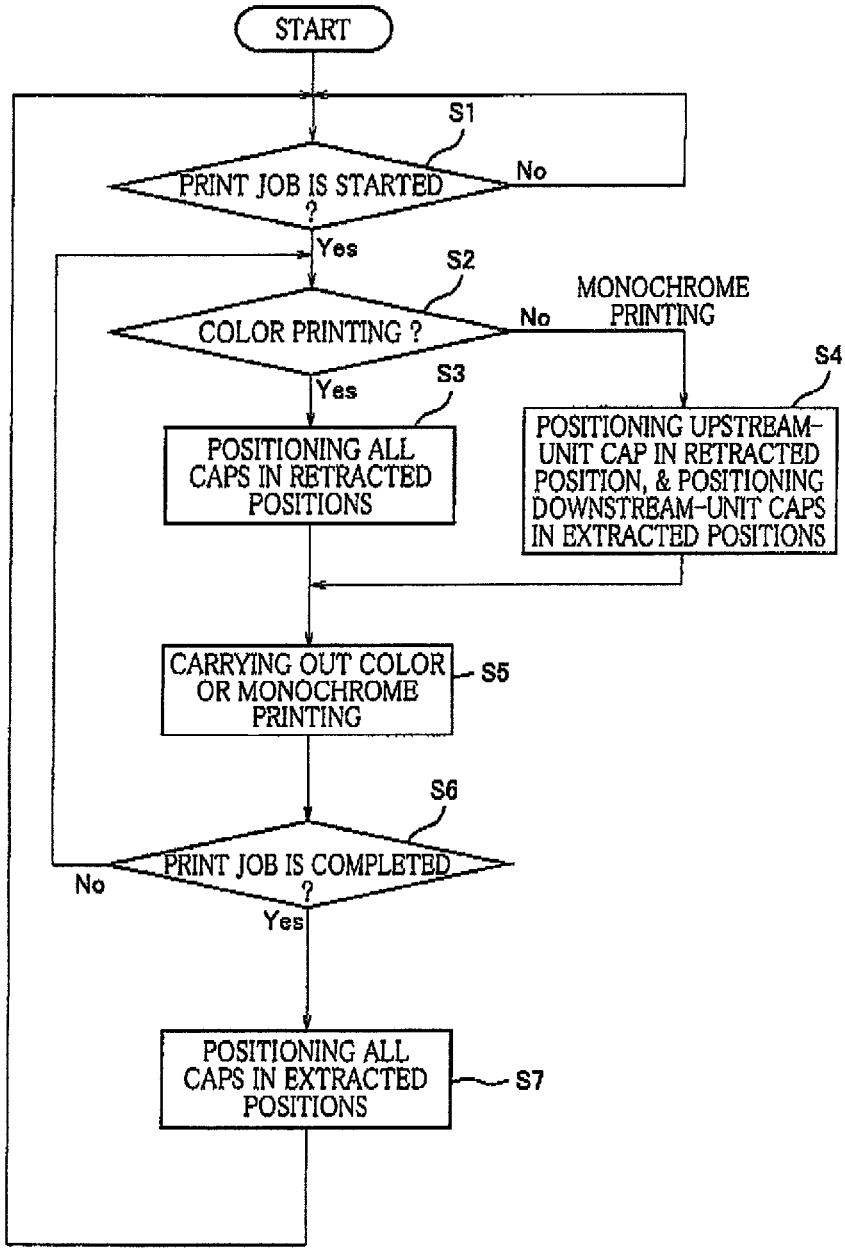
FIG. 4 is a flow chart showing a control routine executed in the inkjet recording apparatus of FIG. 1.
Figure 5A:
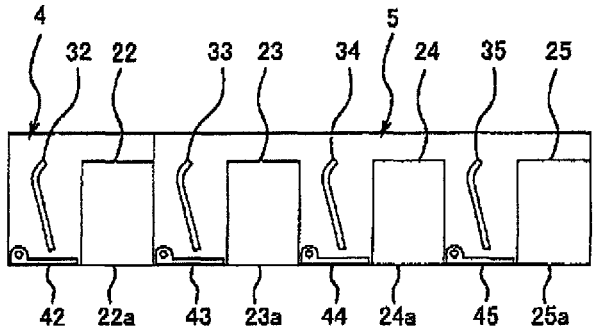
FIG. 5 is a set of views showing activation of the inkjet recording apparatus of FIG. 1 during a monochrome printing.
Figure 5B:
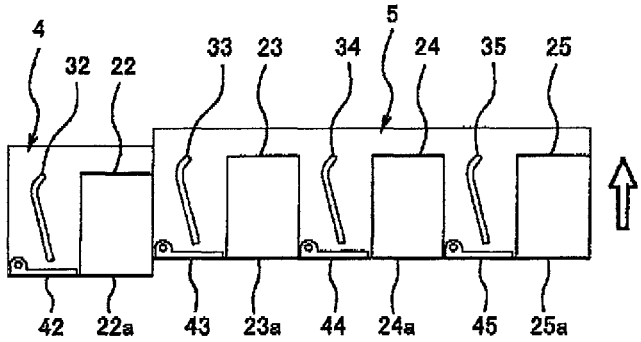
Figure 5C:
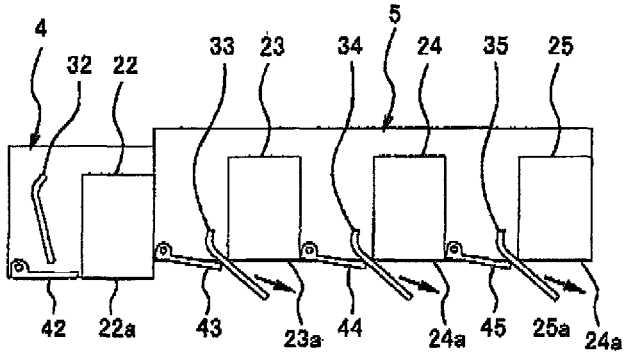
Figure 5D:
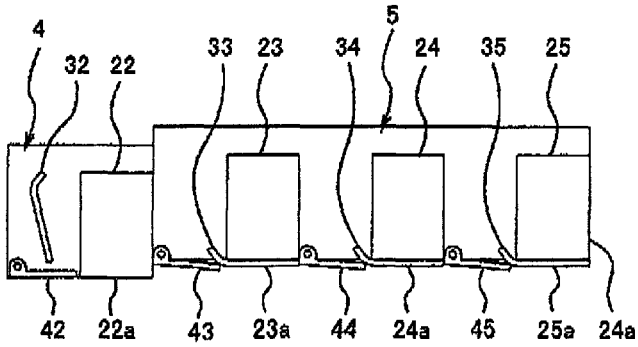

FIG. 4 is a flow chart showing a control routine that is to be executed in the inkjet recording apparatus 1. This control routine is initiated with step S1 in which the controller 62 causes the print-job start/end judging portion 72 to judge whether the print job is started or not. Step S1 is repeated until it is judged that the print job is started. When it is judged in step S1 that the print job is started, the control flow goes to step S2 in which the controller 62 causes the monochrome/color judging portion 71 to judge whether a color printing or a monochrome printing is performed by the print job.

When it is judged in step S2 that a color printing is performed by the print job, the control flow goes to step S3 in which the upstream-unit cap motor 65 and downstream-unit cap motor 66 are controlled such that all the caps 32-35 are positioned in the retracted positions. In this instance, while the caps 32-35 are positioned in the retracted positions, the controller 62 controls the upstream-unit elevating motor 63 and downstream-unit elevating motor 64 such that the upstream unit 4 and downstream unit 5 are positioned in lower positions (i.e., loaded positions) that are in proximity with the belt conveyor 15. Step S3 is followed by step S5 in which the controller 62 controls the recording heads 22-25, for thereby carrying out the color printing.

On the other hand, when it is judged in step S2 that a monochrome printing is performed by the print job, the control flow goes to step S4 in which the upstream-unit cap motor 65 and downstream-unit cap motor 66 are controlled such that the upstream unit cap 32 is positioned in the retracted position while the downstream unit caps 33-35 are positioned in the extracted positions.

FIG. 5 is a set of views showing activation of the inkjet recording apparatus 1 during a monochrome printing. View (a) of FIG. 5 shows an initial stage in which all the caps 32-35 are positioned in the retracted positions while the upstream unit 4 and downstream unit 5 are positioned in the lower positions. In this stage shown in view (a) of FIG. 5 in which the caps 32-35 are positioned in the retracted positions, the guides 42-45 are positioned in the closing positions for completely closing the movement paths of the caps 32-35. In other words, when being positioned in the closing position, wherein each of the guides 42-45 is caused to separate a corresponding one of the adjacent space S2-S5 from the sheet conveyance space S1. In a stage shown in view (b) of FIG. 5 in which it is judged that the monochrome printing is performed by the print job, the controller 62 causes the downstream-unit elevating motor 64 to move upwardly the downstream unit 5 to an upper position (i.e., unloaded position) that is distant from the belt conveyor 15.

Then, in a stage shown in view (c) of FIG. 5, the controller 62 causes the downstream-unit cap motor 66 to move the downstream unit caps 33-35 from the retracted positions to the extracted positions. In this instance, the guides 48-45 of the downstream unit 5, which have been positioned in the closing positions for completely closing the movement paths of the caps 32-35, are forced by the caps 33-35 to be downwardly opened against elastic forces of the springs 56. That is, when the caps 33-35 are moved from the retracted positions to the extracted positions, the guides 43-45 are moved to the opening positions for opening the movement paths of the caps 33-35. More specifically, each of the guides 43-45 is caused, by a corresponding one of the caps 33-35 that is moved from the retracted position to the extracted position, to be pivoted about the supported shaft 55 as a fulcrum portion, whereby the downstream end portion 54*a* of each of the guides 43-45 is displaced in a downward direction, i.e., in a clearance increasing direction that increase a clearance between the downstream end portion 54*a* and a corresponding one of the recording heads 23-25, for thereby allowing the corresponding one of the cape 33-35 to be moved from the retracted position to the extracted position via the clearance along the movement path.

Thereafter, in a stage shown in view (d) of FIG. 5, the caps 33-35 are positioned in the extracted positions for covering the nozzle-opening surfaces 23*a*-25*a* of the recording heads 23-25 (see also FIG. 2), and the downstream end portions of the guides 43-45 are caused to overlap with lower surfaces of the inclined wall portions of the caps 33-35, so as to be slightly inclined. Thus, in this stage shown in view (d) of FIG. 5, each of the guides 43-45 is positioned in the closing position for closing a part of the movement path of a corresponding one of the caps 33-35. Further, in this stage of view (d) of FIG. 5, the downstream unit caps 33-35 are positioned in the extracted positions while the upstream unit cap 32 is positioned in the retracted position, and lower surfaces of the downstream unit caps 33-35 are located in positions higher than the nozzle-opening surface 22*a* of the recording head 22 of the upstream unit 4. In step S5, the monochrome print is carried out by activating the recording head 22 of the upstream unit 4 without activating the recording heads 23-25 of the downstream unit 5, while the lower surfaces of the downstream unit caps 33-35 are kept higher than the nozzle-opening surface 22*a* of the recording head 22 of the upstream unit 4. It is noted that, in this instance, the lower surfaces of the downstream unit caps 33-35 may lie on substantially the same plane on which the nozzle-opening surface 22*a* of the recording head 22 of the upstream unit 4 lies.

Referring back to FIG. 4, step S5 is followed by step S6 in which the controller 62 judges whether the print job is ended or not. When the print job is not ended, the control flow goes back to step S2. When the print job is ended, after a given length of time has passed, step S7 is implemented to control the upstream-unit cap motor 65 and downstream-unit cap motor 68 such that the all the caps 32-35 are positioned in the extracted positions. In this instance, the controller 62 causes the upstream unit 4 and downstream unit 5 to be positioned in the upper positions (distant from the belt conveyor 15) by the upstream-unit elevating motor 63 and downstream-unit elevating motor 64, and then causes the caps 32-35 to be moved to the extracted positions.

In the inkjet recording device 1 constructed as described above, the caps 32-35 are moved from the retracted positions (i.e., non-covering positions) to the extracted positions covering positions), causing opening movements of the guides 42-45, namely, causing the guides 42-45 to be moved to the opening positions, for thereby making it possible to protect the nozzles of the recording heads 22-25 from being dried and to avoid foreign substances from adhering to the nozzles. Further, all of the guides 42-45 are positioned in the closing positions when the caps 32-85 are positioned in the retracted positions during a color printing that is performed onto a sheet with ink ejections from the recording heads 22-25, so that it is possible to avoid the sheet from entering the adjacent spaces S2-S5 (in which the retracted caps 32-35 are located) and accordingly to prevent occurrence of problematic jamming of the sheet during the color printing. Still further, all of the guides 42-45 are positioned in the closing positions even when the upstream unit cap 32 is positioned in the retracted position while the downstream unit caps 33-35 are positioned in the extracted positions during a monochrome printing that is performed onto a sheet with ink ejection from the black recording head 22, so that it is possible to avoid the sheet from entering the adjacent spaces S2-S5 (in which the caps 32-35 are to be located when being positioned in the retracted positions) and accordingly to prevent occurrence of problematic jamming of the sheet also during the monochrome printing.

Further, in the stage shown in view (d) of FIG. 5, a lower end of the downstream unit 5 (assigned for a color printing) is located higher than a lower end of the upstream unit 4 (assigned for a monochrome printing), so that there is a step between the two units 4, 5. However, since the downstream unit 5 (whose lower end is located higher than the lower end of the upstream unit 4) is located on a downstream side of the upstream unit 4, a leading end of the conveyed sheet is unlikely to be brought into contact with the step, and accordingly there is substantially no risk that the conveyance of the sheet is impeded by the step. Still further, during a monochrome printing in which the downstream-unit caps 33-35 are positioned in the extracted positions, the downstream end portions of the guides 43-45 of the downstream unit 5 are located lower (i.e., closer to the sheet conveyance space S1) than when the downstream-unit caps 33-35 are positioned in the retracted positions, so that it is possible to reduce a step between the lower surface of each of the guides 43-45 and the lower surface of a corresponding one of the caps 33-35 (that are positioned in the extracted positions), thereby contributing for prevention of occurrence of sheet jamming.

As is clear from the above description, in the line-type inkjet recording apparatus 1 having the plurality of recording heads 22-25 arranged in the sheet conveyance direction, both of the protection of the nozzles by the caps 32-35 and the prevention of sheet jamming can be made satisfactorily. It should be noted that the present embodiment is merely an example of the present invention, and that the embodiment may be modified or changed as needed without departing from the spirit of the invention. For example, in the present embodiment, the spring 56 as an elastic member is employed for providing each of the guides 42-45 with an elastic force forcing each of the guides 42-45 to be moved away from the opening position toward the closing position. However, instead of employing the elastic member such as the spring 56, each of the guides 42-45 as such may be formed of an elastic material such as a rubber. Further, in the present embodiment, each of the guides 42-45 is constituted by a generally plate-like shaped member. However, each of the guides 42-45 may be constituted by otherwise shaped member such as mesh-structured member, as long as it is capable of guiding the sheet to be conveyed along the sheet conveyance path, without permitting the sheet to enter the adjacent spaces S2-S5.

[Second Embodiment]

Figure 6:
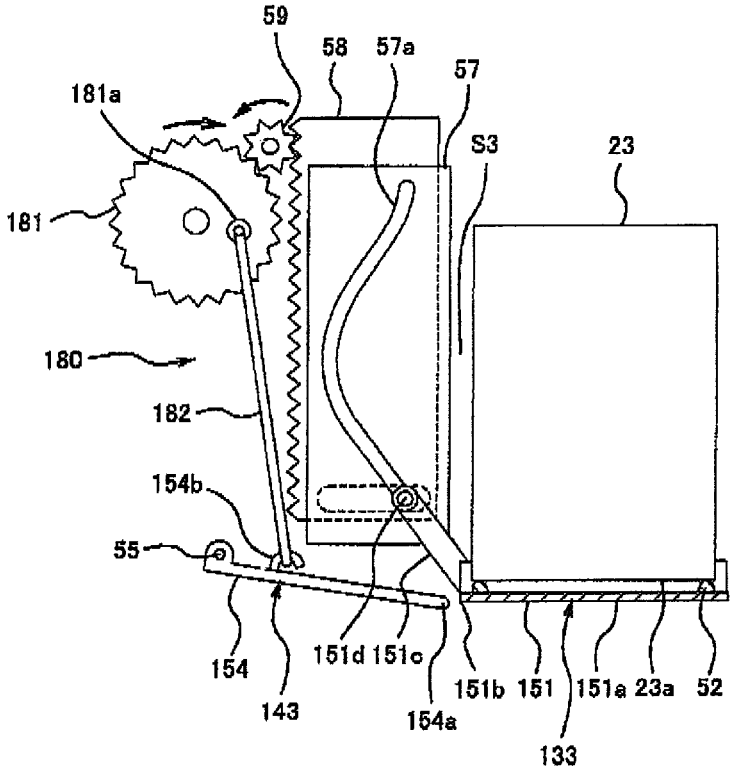
FIG. 6 is a view showing, in enlargement, a major portion of an inkjet recording apparatus constructed according to a second embodiment of the invention.

FIG. 6 is a view showing, in enlargement, a major portion of an inkjet recording apparatus constructed according to a second embodiment of the invention. In the following description regarding this second embodiment, the same reference numerals as used in the first embodiment will be used to identify the same or similar elements, and redundant description of these elements will not be provided. As shown in FIG. 6, the inkjet recording apparatus according to the second embodiment includes a link mechanism 180 that is configured to link movement of a guide 143 with movement of a cap 133. This link mechanism 180 may be referred also to as movement converting mechanism that is configured to convert an unidirectional movement of the cap 138 from the retracted position to the extracted position or from the extracted position to the retracted position, into a reciprocating movement of the guide 143 between the closing position and the opening position.

Described specifically, the cap 133 includes a cap body 151 and the above-described seal member 52 that protrudes from the cap body 151. The cap body 151 is made principally of a resin, and serves to cover the nozzle-opening surface 28*a*. The seal member 52 is made of an elastic member, and serves to surround all the nozzles opening in the nozzle-opening surface 23*a* when being in contact with the nozzle-opening surface 28*a*. FIG. 6 shows a state in which the cap 133 is positioned in the extracted position. The cap body 151 includes a base portion 151*a*, an arm portion 151*c* and a shaft portion 151*d*. The base portion 151*a* is opposed to the nozzle-opening surface 23*a*. The arm portion 151*c* protrudes from the base portion 151*a* toward the adjacent space S3. The shaft portion 151*d* protrudes from the arm portion 51*c* in a longitudinal direction of the recording head 23 (i.e., in a direction away from a front side of the drawing sheet of FIG. 2 toward a rear side of the drawing sheet of FIG. 6). That is, the cap 188 does not include an inclined wall portion like the inclined wall portion 51*b* in the first embodiment.

The guide 143 includes a plate-like shaped guide body 154 and the above-described supported shaft 55. The guide body 154 is made principally of a resin. The supported shaft 55 projects from an upstream end portion, as viewed in the sheet conveyance direction, of the guide body 154 in the longitudinal direction of the recording head 28. A hook-shaped connecting portion 154*b* is provided to project from an upper surface of the guide body 154. A link rod 182 is connected at one of its opposite end portions to the connecting portion 154*b* of the guide 148, pivotably relative to the guide 143. The link rod 182 is connected at the other of its opposite end portions to a connecting portion 181*a* of a speed reduction gear 181 (that meshes with the pinion 59), pivotably relative to the gear 181. The connecting portion 181*a* is provided on a side surface of the gear 181. When the pinion 59 is rotated in a single direction for causing the cap 133 to be moved between the extracted position and the retracted position, the guide 143 is reciprocated through the speed reduction gear 181 and the link rod 182, between the closing position and the opening position, in linkage with the rotation of the pinion 69. That is, in linkage with the movement of the cap 133 from the retracted position to the extracted position, the guide 143 is moved from the closing position to the opening position for opening the movement path of the cap 133, and is then moved back from the opening position to the closing position after the cap 133 has passes through the clearance between the downstream end portion 154*a* of the guide 143 and the recording head 23.

The link mechanism 180 is constructed, such that the guide 143 takes a horizontal posture with a lower surface of the guide 148 being flush with the nozzle-opening surface 28*a* of the recording head 23, when the cap 133 is positioned in the retracted position, and such that the guide 143 takes an inclined posture with the lower surface of the guide 143 being inclined downwardly in the sheet conveyance direction, when the cap 133 is positioned in the extracted position. That is, when the cap 133 is positioned in the extracted position, the downstream end portion 154*a* of the guide 143 is located in a position which is substantially the same as or which is lower (closer to the sheet conveyance space S1) than when the cap 138 is positioned in the retracted position. Owing to this arrangement, an imaginary surface defined by the lower surfaces of the guide 143 and the cap 133 is made smooth, thereby contributing for prevention of occurrence of sheet jamming.

While the presently preferred embodiments of the invention have been described above in detail, it is to be understood that the invention is not limited to the details of the illustrated embodiments, but may be otherwise embodied without departing from the spirit of the invention. For example, while the guide 43 or 143 is moved by the spring 56 or link mechanism 180 in the above-described embodiments, the guide may be moved by a motor that is provided to serve exclusively for moving the guide. Further, in the above-described embodiments, the caps 32-35 are retracted into the respective four adjacent spaces S2-S5 wherein each of the three adjacent spaces S3-S5 is defined between a corresponding pair of the recording heads 22-25. However, each of the adjacent spaces does not necessarily have to be defined between corresponding two of the recording heads 22-25, but may be defined between a corresponding one of the recording heads 22-25 and a member (such as roller and light source) other than the other recording heads. Further, in the above-described embodiments, the caps 32-35 and guides 42-45 are moved by the motors 65, 66 under control by the controller 62. However, the caps 32-35 and guides 42-45 may be moved manually. Still further, the above-described embodiments may be combined with each other as needed, for example, by applying a part of one of the embodiments to the other of the embodiments.

As described above, the inkjet recording apparatus constructed according to the present invention provides excellent effects enabling both of the protection of the nozzles and the prevention of sheet jamming to be made satisfactorily. Thus, the present invention is applicable widely to various kinds of inkjet recording apparatus such as a line-type inkjet printer to which the effects are significant.

What is claimed is:

1. An inkjet recording apparatus comprising:

at least one recording head each having a nozzle-opening surface and configured to eject ink through nozzles opening in said nozzle-opening surface, toward a sheet conveyance space through which a recording sheet is to be conveyed in a sheet conveyance direction;

at least one cap each movable along a movement path between an extracted position and a retracted position, such that each of said at least one cap covers said nozzle-opening surface of a corresponding one of said at least one recording head, when being positioned in the extracted position, and such that each of said at least one cap is located in an adjacent space adjacent to a corresponding one of said at least one recording head in the sheet conveyance direction without covering said nozzle-opening surface of said corresponding one of said at least one recording head, when being positioned in the retracted position;

at least one guide each movable between a closing position and an opening position, such that each of said at least one guide is closer to the sheet conveyance space than a corresponding one of said at least one cap positioned in the retracted position so as to guide the recording sheet to be conveyed through the sheet conveyance space and so as to close at least a part of the movement path of said corresponding one of said at least one cap, when being positioned in the closing position, and such that each of said at least one guide opens the movement path of a corresponding one of said at least one cap, when being positioned in the opening position; and each of said at least one guide being positioned in the opening position when a corresponding one of said at least one cap is moved between the extracted position and the retracted position, and being positioned in the closing position when said corresponding one of said at least one cap is positioned in the retracted position, wherein each of said at least one guide is caused, when being positioned in the closing position, to separate the adjacent space from the sheet conveyance space, and wherein each of said at least one guide includes a recording-head-side end portion which is adjacent to a corresponding one of said at least one recording head, said recording-head-side end portion being caused, when said each of said at least one guide is moved from the closing position to the opening position, to be displaced in a clearance increasing direction that increases a clearance between said recording-head-side end portion and said corresponding one of said at least one recording head, for thereby allowing a corresponding one of said at least one cap to be moved from the refracted position to the extracted position via the clearance along the movement path.

2. The inkjet recording apparatus according to claim 1, wherein each of said at least one guide includes an end portion, which is adjacent to a corresponding one of said at least one cap when said corresponding one of said at least one cap is positioned in the extracted position, and wherein said end portion of each of said at least one guide overlaps with an opposed surface of a corresponding one of said at least one cap which is opposed to the sheet conveyance space, when said corresponding one of said at least one cap is positioned in the extracted position.

3. The inkjet recording apparatus according to claim 1, wherein each of said at least one guide receives an elastic force forcing said each of said at least one guide to be moved away from the opening position toward the closing position, and wherein each of said at least one cap is caused, when being moved from the retracted position to the extracted position, to force a corresponding one of said at least one guide to be moved against the elastic force in a direction away from the closing position toward the opening position.

4. The inkjet recording apparatus according to claim 1, further comprising a link mechanism configured to link movement of each of said at least one guide with movement of a corresponding one of each of said at least one cap, wherein said link mechanism is configured to cause each of said at least one guide to be moved from the closing position to the opening position when a corresponding one of each of said at least one cap is moved between the retracted position and the extracted position.

5. The inkjet recording apparatus according to claim 1, wherein each of said at least one guide is pivotable about a fulcrum portion thereof that is distant from said recording-head-side end portion such that said recording-head-side end portion is displaceable in the clearance increasing direction and a direction opposite to the clearance increasing direction by pivot motion of said each of said at least one guide about the fulcrum portion.

6. The inkjet recording apparatus according to claim 1, wherein said at least one recording head includes a first recording head and a second recording head-which is spaced apart from said first recording head in the sheet conveyance direction, wherein said at least one cap includes a first cap and a second cap which are provided for said first recording head and said second recording head, respectively, said second cap being movable independently of said first cap, wherein said at least one guide includes a first guide and a second guide which are provided for said first cap and said second cap, respectively, said second guide being movable independently of said first guide, and wherein said second guide is positioned in the closing position, when said first cap is positioned in the retracted position and said second cap is positioned in the extracted position.

7. The inkjet recording apparatus according to claim 6, wherein said second recording head is disposed on a downstream side of said first recording head in the sheet conveyance direction, wherein said nozzle-opening surface of said first recording head and said nozzle-opening surface of said second recording head are flush with each other, when said second cap is positioned in the retracted position, wherein said second recording head is moved in a direction away from the sheet conveyance space, when said second cap is moved from the retracted position to the extracted position, and wherein an opposed surface of said second cap, which is opposed to the sheet conveyance space, is not closer to the sheet conveyance space than said nozzle-opening surface of said first recording head, when said second cap is positioned in the extracted position.

8. The inkjet recording apparatus according to claim 6, further comprising:

a first-cap driving source configured to be activated to move said first cap between the extracted position and the retracted position; and a second-cap driving source configured to be activated to move said second cap between the extracted position and the retracted position, wherein said first-cap driving source and said second-cap driving source are activatable independently of each other.

9. An inkjet recording apparatus comprising:

at least one recording head each having a nozzle-opening surface and configured to eject ink through nozzles opening in said nozzle-opening surface, toward a sheet conveyance space through which a recording sheet is to be conveyed in a sheet conveyance direction;

at least one cap each movable along a movement path between an extracted position and a retracted position, such that each of said at least one cap covers said nozzle-opening surface of a corresponding one of said at least one recording head, when being positioned in the extracted position, and such that each of said at least one cap is located in an adjacent space adjacent to a corresponding one of said at least one recording head in the sheet conveyance direction without covering said nozzle-opening surface of said corresponding one of said at least one recording head, when being positioned in the retracted position;

at least one guide each movable between a closing position and an opening position, such that each of said at least one guide is closer to the sheet conveyance space than a corresponding one of said at least one cap positioned in the retracted position so as to guide the recording sheet to be conveyed through the sheet conveyance space and so as to close at least a part of the movement path of said corresponding one of said at least one cap, when being positioned in the closing position, and such that each of said at least one guide opens the movement path of a corresponding one of said at least one cap, when being positioned in the opening position; and each of said at least one guide being positioned in the opening position when a corresponding one of said at least one cap is moved between the extracted position and the retracted position, and being positioned in the closing position when said corresponding one of said at least one cap is positioned in the retracted position, wherein each of said at least one guide is positioned in the closing position when a corresponding one of said at least one cap is positioned in the extracted position as well as when said corresponding one of said at least one cap is positioned in the retracted position.

10. The inkjet recording apparatus according to claim 9, wherein each of said at least one guide is caused, when a corresponding one of said at least one cap is positioned in the retracted position, to close an entirety of the movement path of said corresponding one of said at least one cap, and wherein each of said at least one guide is caused, when a corresponding one of said at least one cap is positioned in the extracted position, to close the part of the movement path of said corresponding one of said at least one cap.

11. The inkjet recording apparatus according to claim 9, wherein each of said at least one guide includes an end portion, which is adjacent to a corresponding one of said at least one cap when said corresponding one of said at least one cap is positioned in the extracted position, and wherein said end portion of each of said at least one guide overlaps with an opposed surface of a corresponding one of said at least one cap which is opposed to the sheet conveyance space, when said corresponding one of said at least one cap is positioned in the extracted position.

12. The inkjet recording apparatus according to claim 9, wherein each of said at least one guide receives an elastic force forcing said each of said at least one guide to be moved away from the opening position toward the closing position, and wherein each of said at least one cap is caused, when being moved from the retracted position to the extracted position, to force a corresponding one of said at least one guide to be moved against the elastic force in a direction away from the closing position toward the opening position.

13. The inkjet recording apparatus according to claim 9, further comprising a link mechanism configured to link movement of each of said at least one guide with movement of a corresponding one of each of said at least one cap, wherein said link mechanism is configured to cause each of said at least one guide to be moved from the closing position to the opening position when a corresponding one of each of said at least one cap is moved between the retracted position and the extracted position.

14. The inkjet recording apparatus according to claim 9, wherein said at least one recording head includes a first recording head and a second recording head which is spaced apart from said first recording head in the sheet conveyance direction, wherein said at least one cap includes a first cap and a second cap which are provided for said first recording head and said second recording head, respectively, said second cap being movable independently of said first cap, wherein said at least one guide includes a first guide and a second guide which are provided for said first cap and said second cap, respectively, said second guide being movable independently of said first guide, and wherein said second guide is positioned in the closing position, when said first cap is positioned in the retracted position and said second cap is positioned in the extracted position.

15. The inkjet recording apparatus according to claim 14, wherein said second recording head is disposed on a downstream side of said first recording head in the sheet conveyance direction, wherein said nozzle-opening surface of said first recording head and said nozzle-opening surface of said second recording head are flush with each other, when said second cap is positioned in the retracted position, wherein said second recording head is moved in a direction away from the sheet conveyance space, when said second cap is moved from the retracted position to the extracted position, and wherein an opposed surface of said second cap, which is opposed to the sheet conveyance space, is not closer to the sheet conveyance space than said nozzle-opening surface of said first recording head, when said second cap is positioned in the extracted position.

16. The inkjet recording apparatus according to claim 14, further comprising:

a first-cap driving source configured to be activated to move said first cap between the extracted position and the retracted position; and a second-cap driving source configured to be activated to move said second cap between the extracted position and the retracted position, wherein said first-cap driving source and said second-cap driving source are activatable independently of each other.

17. The inkjet recording apparatus according to claim 9, wherein each of said at least one guide is caused, when being positioned in the closing position, to separate the adjacent space from the sheet conveyance space, and wherein each of said at least one guide includes a recording-head-side end portion which is adjacent to a corresponding one of said at least one recording head, said recording-head-side end portion being caused, when said each of said at least one guide is moved from the closing position to the opening position, to be displaced in a clearance increasing direction that increases a clearance between said recording-head-side end portion and said corresponding one of said at least one recording head, for thereby allowing a corresponding one of said at least one cap to be moved from the refracted position to the extracted position via the clearance along the movement path.

18. The inkjet recording apparatus according to claim 17, wherein each of said at least one guide is pivotable about a fulcrum portion thereof that is distant from said recording-head-side end portion such that said recording-head-side end portion is displaceable in the clearance increasing direction and a direction opposite to the clearance increasing direction by pivot motion of said each of said at least one guide about the fulcrum portion.

* * * * *